United States Patent [19]

Johnson

[11] Patent Number: 4,497,472

[45] Date of Patent: Feb. 5, 1985

[54] VEGETATION BLOCKING FENCE EDGING ASSEMBLY

[76] Inventor: J. Darrel Johnson, 16289 Bardbury, Middleburg Heights, Ohio 44130

[21] Appl. No.: 441,685

[22] Filed: Nov. 15, 1982

[51] Int. Cl.[3] ..... E04H 17/06

[52] U.S. Cl. ..... 256/32; 256/1

[58] Field of Search ..... 256/1, 32

[56] References Cited

U.S. PATENT DOCUMENTS

| | | | |
|---|---|---|---|
| 3,384,351 | 5/1968 | Turner, Jr. | 256/32 |
| 3,393,897 | 7/1968 | Wright | 256/32 |
| 3,515,373 | 6/1970 | Abbe | 256/32 |
| 3,676,952 | 7/1972 | Watts | 256/32 X |
| 3,704,004 | 11/1972 | Carter, Jr. | 256/1 |
| 3,713,624 | 1/1973 | Niemann | 256/32 |
| 3,768,780 | 10/1973 | Cowles | 256/32 X |
| 3,806,096 | 4/1974 | Eccleston et al. | 256/32 |
| 3,822,864 | 7/1974 | Keys | 256/32 |

*Primary Examiner*—Andrew V. Kundrat
*Attorney, Agent, or Firm*—Fay & Sharpe

[57] ABSTRACT

The vegetation blocking fence edging assembly includes a fence structure (A), a plurality of elongated edging strips (B), and a plurality of fence post edging structures (C). The fence structure includes a plurality of mounting posts (10) between which a fencing medium (12) extends. The edging strip has U-shaped slots (42) at its longitudinal ends (30) which are adapted to be received around the fence mounting posts. The edging strip includes a longitudinally extending, generally J-shaped portion (32) made up of a U-shaped portion (34) for receiving the lower edge of the fence medium and a single guide edge (36) for engaging one face of the fence. Flanges (38, 40) extend from either side of the J-shaped portion at a downward angle to contact the ground. The flange portions are resilient plastic and bias the J-shaped portion and the U-shaped portion toward engagement with the fence lower edge. The fence post edging structure has a post engaging surface (60) which is slightly smaller than the peripheral surface of the fence post such that it biases itself into firm engagement with the fence post periphery.

16 Claims, 7 Drawing Figures

VEGETATION BLOCKING FENCE EDGING ASSEMBLY

BACKGROUND OF THE INVENTION

The present invention pertains to the art of fencing and vegetation control. More particularly, the present invention pertains to an edging strip for placement along the lowermost edge of chain link and other fences for inhibiting the growth of vegetation therealong.

Heretofore, various edging systems have been proposed for controlling the growth of vegetation along the lower edge of chain link and other fence systems. Some of these prior arts fencing systems were wide, flat strips which rested on the earth. Commonly, provision was made for receiving the fencing posts and for engaging the earth more securely. See for example U.S. Pat. No. 3,393,897, issued July, 1968 to L. E. Wright; U.S. Pat. No. 3,515,373, issued June, 1970 to D. M. Abbe; U.S. Pat. No. 3,676,952, issued July, 1972 to R. M. Watts; U.S. Pat. No. 3,806,096, issued April, 1974 to J. R. Eccleston et al; and U.S. Pat. No. 3,822,864, issued July, 1974 to G. L. Keys.

Others have suggested that the edging strip provide for positive engagement with the lower edge of the chain link or other fencing. Such an engagement may be achieved with a generally U-shaped recess for receiving the lowermost edge of the fence. See for example U.S. Pat. No. 3,384,351, issued May, 1968 to A. W. Turner, Jr. However, flexible fencing, such as chain link fence, tends to be flexed strenuously from its normal position by children, pets, and the like. To contain the lowermost edge of the fence more securely, others have suggested providing upstanding flanges which extend along the front and back faces of the chain link or other flexible fencing. See for example U.S. Pat. No. 3,713,624, issued January, 1973 to F. T. Niemann and U.S. Pat. No. 3,768,780. issued October, 1973 to T. Cowles et al. Although providing secure engagement with the lower edge of a chain link fence, the upward extending flange portions tend to make installation on existing fences difficult.

The present invention contemplates a new and improved fence edging system which is easy to install, yet reliably remains in engagement with the fencing lowermost edge.

SUMMARY OF THE INVENTION

In accordance with one aspect of the present invention, there is provided a one piece, extruded plastic edging strip for inhibiting the growth of vegetation along fences. The edging strip includes a generally J-shaped, longitudinally extending portion which engages the lower fence edge. The J-shaped fence engaging portion includes a relatively shallow U-shaped channel for receiving the lower edge of the fence and a single guide strip extending from the U-shaped channel to engage one face of the fence. A longitudinally extending vegetation shield portion including first and second flanges extends transversely from opposite sides of the J-shaped portion. In this manner, the edging strip is adapted to be inserted relatively easily under the fence lower edge while still providing engagement with the fence.

In accordance with another aspect of the invention, there is provided a combined fence and vegetation inhibiting edging assembly. A fence structure includes a plurality of regularly spaced fence mounting posts and a flexible fencing medium which extends between the fence mounting posts. The fencing medium terminates adjacent the ground with a lower edge. An annular mounting post edging structure is disposed around each fence mounting post. The mounting post edging structure has an inner opening which is dimensioned for tight frictional engagement with an associated fence mounting post to inhibit the growth of vegetation therebetween. A plurality of longitudinally extending edging strips extend between adjacent fence mounting posts. Each edging strip includes a generally J-shaped longitudinally extending fence engaging portion which receives the lower fence edge and engages a single face of the fencing medium. First and second flanges extend transversely to opposite sides of the J-shaped fence engaging portion to inhibit the growth of vegetation to either side of the fence lower edge. One of the flanges has generally U-shaped slots at its longitudinal ends which are dimensioned for loosely receiving adjacent fence mounting posts. The longitudinal ends overlays the mounting post edging structure and the longitudinal end of an adjacent strip. In this manner, vegetation is blocked from growing to either side of the fence lower edge as well as from growing between the edging strips and the fence mounting posts.

One advantage of the present invention is that it is relatively easy to install on existing, previously installed chain link and like fences.

Another advantage of the present invention is that once installed it securely and reliably remains in place and continues to perform its edging functions.

Yet another advantage of the present invention is that it reliably continues to block vegetation growth as it expands and contracts with changes in temperature.

Still further advantages of the present invention will become apparent upon reading and understanding the following detailed description of the preferred embodiment.

BRIEF DESCRIPTION OF THE DRAWINGS

The invention may take form in various configurations and combinations of structural portions. The drawings are only for purposes of illustrating a preferred embodiment of the invention and are not to be construed as limiting it.

DETAILED DESCRIPTION OF THE PREFERRED EMBODIMENT

Figure 1:
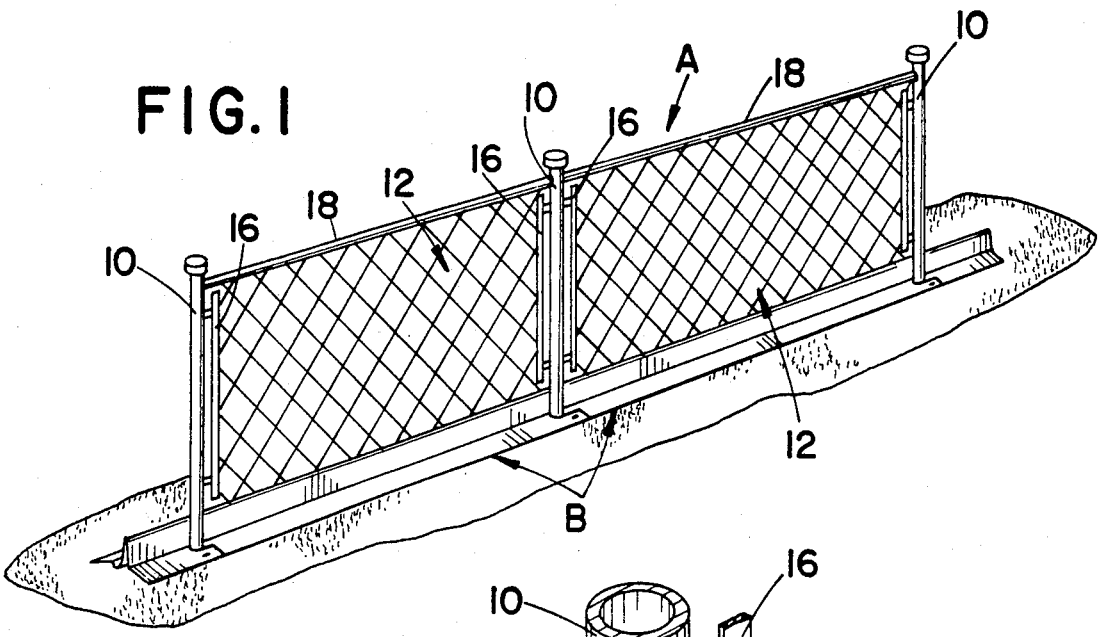
FIG. 1 is a perspective view of a fencing structure in combination with an edging strip in accordance with the present invention.
Figure 2:
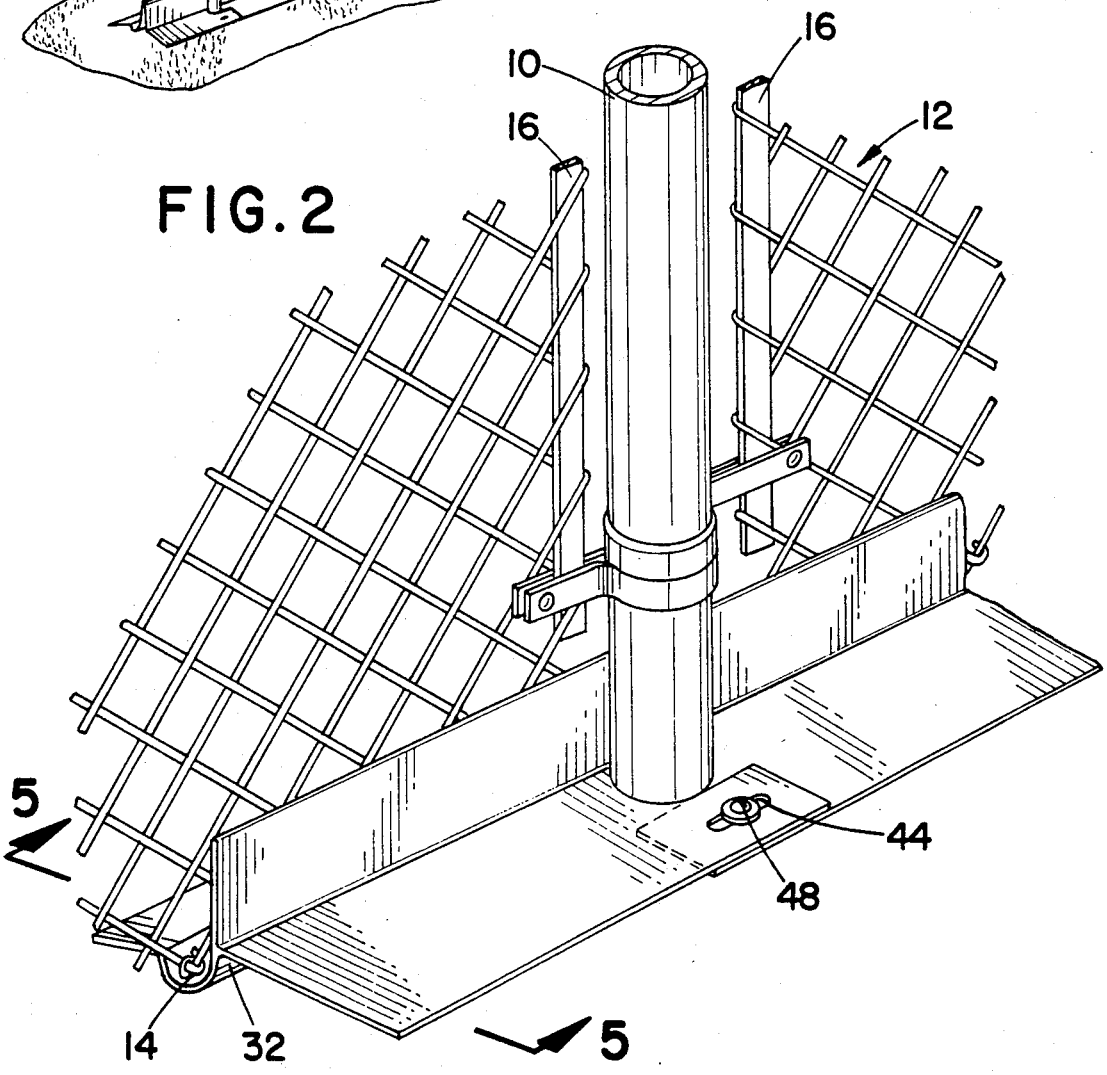
FIG. 2 is an enlarged view of a portion of FIG. 1 adjacent one of the fence mounting posts.

With particular reference to FIGS. 1 and 2, a fence structure A is bordered on its lowermost edge by a plurality of one piece, extruded vinyl edging strips B.

Annular, vinyl fence post edging structures C (FIGS. 5 and 7) provide a vegetation growth barrier closely adjacent the periphery of each mounting post of the fence structure A.

The fence structure A includes a plurality of fence mounting posts 10 disposed at regular intervals, e.g. 8–10 feet. In the preferred embodiment, the fence posts are cylindrically tubular galvanized steel posts. However, posts of other cross sections and constructed of other materials such as rectangular posts or wooden posts, can be accommodated by the present invention. A flexible fencing medium 12 extends between the fence posts and terminates adjacent the ground with a lower fence edge 14. In the preferred embodiment, the flexible fencing medium is chain link fence which is stretched between end support strips 16 which, in turn, are connected with the fence posts. Fence upper edging bars 18 extend between the fence posts to provide protection to the upper edge of the chain link fencing medium and assist in maintaining the posts vertical.

Figure 3:
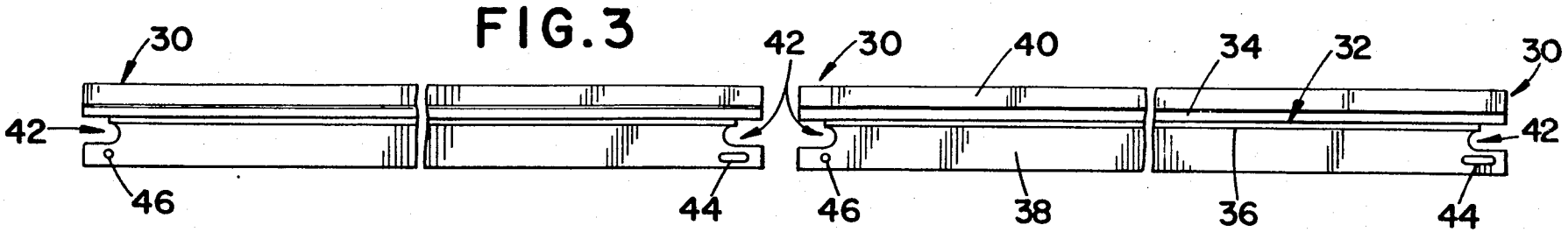
FIG. 3 illustrates a pair of edging strips which are ready for installation around a fence mounting post.
Figure 4:
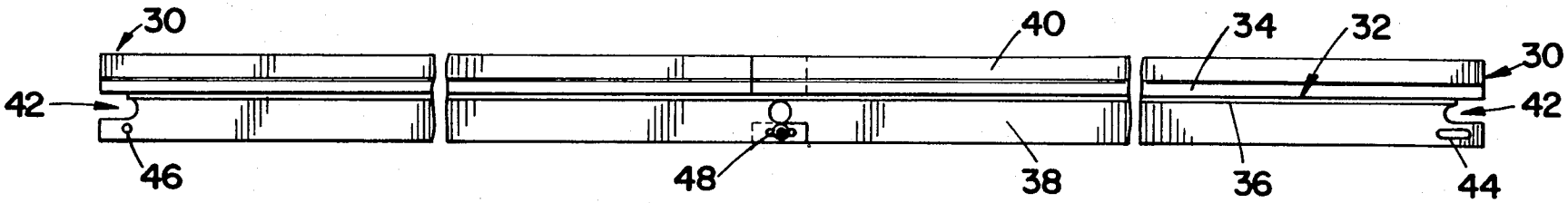
FIG. 4 illustrates the fence edging strips of FIG. 3 in operative interconnection.
Figure 5:
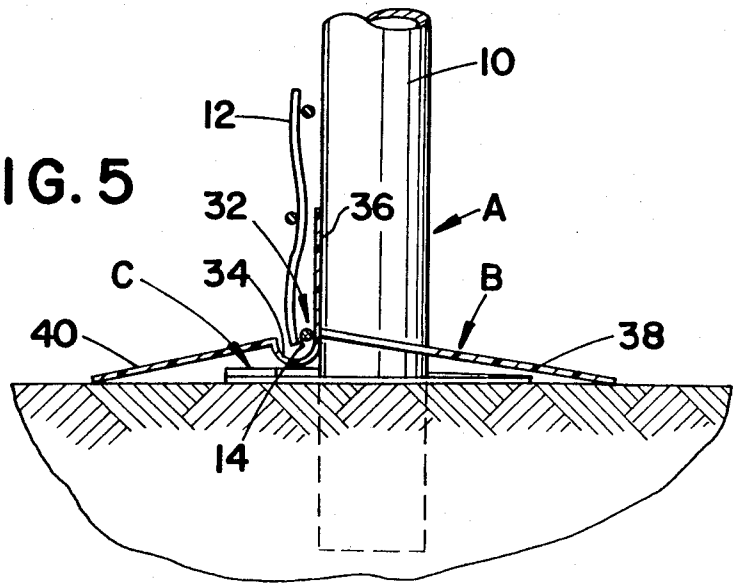
FIG. 5 is a sectional view through section 5—5 of FIG. 2.

With continued reference to FIG. 1 and further reference to FIGS. 3 and 4, the edging strips B have longitudinal end portions 30 which are adapted to be interconnected around the fence posts. With particular reference to FIGS. 2 and 5, the edging strip B has a generally J-shaped fence engaging portion 32 extending between the logitudinal ends. The J-shaped portion includes a shallow, generally U-shaped longitudinally extending portion 34 and a single longitudinally extending guide edge or strip 36. First and second longitudinally extending flanges 38 and 40 are connected longitudinally along the J-shaped portion. Preferably, the first flange is connected closely adjacent to the interconnection of the U-shaped channel and the guide strip and the second flange is connected along the free edge of the U-shaped portion. The first and second flanges extend downward below the lowermost part of the U-shaped portion and engage the ground surface in longitudinally extending outermost edges. The flanges are angled such that the U-shaped portion is disposed off the ground. In this manner, the J-shaped portion of the edging strip is adapted to be flexed downward against the resilient biasing of the flange portions to facilitate its insertion below the frame lower edge. Upon being positioned under the fencing medium, the flanges resiliently urge the U-shaped portion toward continuing contact with the fence lower edge.

With particular reference to FIGS. 2, 3, and 4, the longitudinal ends of the edging strip have generally U-shaped slots 42 which are dimensioned to be received at least partially around the fence posts. Although the slots are shown as having rounded innermost portions for use in conjunction with circular posts, it is to be appreciated that the U-shaped slots may be squared to receive rectangular posts, or the like. Adjacent the U-shaped slots on one end is an elongated slot 44 and at the other end is a small aperture 46 which is adapted to receive a self-tapping screw 48. The guide edge 36 is removed adjacent the U-shaped slot to enable the flanges and the U-shaped portion adjacent the free ends of connected edging strips to be lapped. The elongated slot 44 is dimensioned with sufficient length to accommodate the expansion of the edging strip during hot weather and contraction during cold weather. It is to be appreciated that in the temperature extremes which vary over 100° F. between summer and winter in many parts of the country, that a 10 foot length of the edging strip constructed of the preferred vinyl plastic may expand or contract a significant amount, on the order of a half inch or more. Preferably, the elongated slot is at least 150% of the expansion and contraction length to provide leeway to the installer. Optionally, the edging strip may be constructed of other plastic materials, aluminium, and the like.

Figure 6:
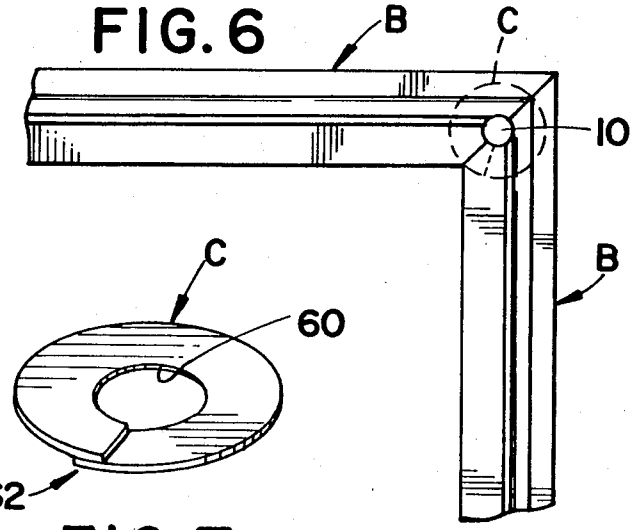
FIG. 6 illustrates interconnection of the edging strips in conjunction with a 90° turn in the fence; and, FIG. 7 is a perspective view of a fence mounting post edging structure in accordance with the present invention.
Figure 7:
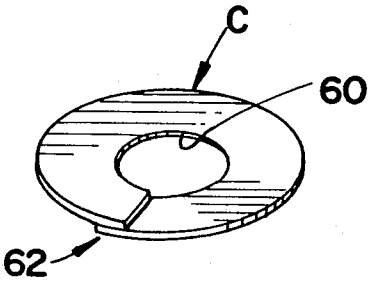

With particular reference to FIGS. 5 and 7, with the temperature change expansion and contraction, the U-shaped slots at the ends of the edging strips may not always be in firm contact with the fence posts. Any gap between the edging strip and the fence post, of course, provides a potential avenue for plant growth. To block the growth of vegetation directly around the fence posts, fence post edging structures C are provided. The fence post edging structures have an inner surface 60 which is dimensioned for tightly engaging the periphery of the fence posts. In the preferred embodiment, the post edging structure is constructed of a resilient plastic. The inner opening 60 is dimensioned slightly smaller than the fence post periphery such that the plastic is resiliently flexed and biases itself into tight engagement with the fence post. In one embodiment, the fence post edging structure has lapping ends 62 to enable it to be expanded for more easily placement around the fence post. Alternately, as illustrated in FIG. 6, the post edging structure may have a radial slot and butting ends.

In installation, the fence post edging structures C are fit around each of the fence posts. If the fencing medium has yet to be installed, the post edging structures may be slid down from the top. If the fencing medium is already installed, as is more common, the post edging structure is flexed open about its radial slot and snapped around the fence posts. The edging strips B are positioned with the second flange 40 adjacent the fence lower edge. The J-shaped portion of the edging strip is urged downward and the edging structure is slid until the single guide strip 36 contacts one face of the fencing medium and is maneuvered against the fencing medium side of the fence post. If the edging strip is the wrong length, the strip may be shortened and a new U-shaped slot arrangement 42 cut into the new end with shears or the like. Alternately, the edging strip may be cut between its ends and the cut ends lapped to the appropriate degree to cause the preformed U-shaped slots to mate with the adjacent fence mounting posts. If necessary, a section may be removed. If the edging strip is too short, it may be cut between its ends and a section analogously added. At corners, the edging strips are cut with the appropriate bias to form a miter joint, as illustrated in FIG. 6.

The invention has been described with reference to the preferred embodiment. Obviously, modifications and alterations will occur to others upon reading and understanding the preceding detailed description of the preferred embodiment. It is intended that the invention be construed as including all such alterations and modifications insofar as they come within the scope of the appended claims or the equivalents thereof.

Having thus described a preferred embodiment of the invention, the invention is now claimed to be:

1. A one piece extruded plastic edging strip for blocking vegetation growth along fences, the edging strip comprising:

a generally J-shaped, longitudinally extending lower fence edge engaging portion which is substantially J-shaped in transverse cross section, the J-shaped fence engaging portion including a generally U-shaped channel for receiving a lower edge of the fence and a single guide strip extending from a first edge of the U-shaped channel for engaging a first face of the fence, whereby the generally J-shaped portion is adapted to be slid under the fence lower edge until the guide strip engages the fence first face; and, a longitudinally extending vegetation shield portion including first and second flanges extending transversely from opposite sides of the J-shaped portion and terminating in substantially linear longitudinally extending first and second flange edges, respectively.

2. The edging strip as set forth in claim 1 wherein the lowermost portion of the U-shaped channel is disposed above a plane defined by the first and second flange edges such that the first and second flanges are adapted to be flexed to bias the U-shaped channel resiliently toward engagement with the fence lower edge.

3. The edging strip as set forth in claim 1 wherein the second flange is integrally connected with a second edge of the U-shaped channel.

4. The edging strip as set forth in claim 3 wherein the first flange is intergrally connected at the junction of the generally U-shaped channel and the fence guide edge.

5. The edging strip as set forth in claim 4 wherein the lowermost portion of the U-shaped channel is disposed above a plane defined by the first and second flange edges such that the first and second flanges are adapted to be flexed toward the plane by interengagement of the fence lower edge and the U-shaped channel to bias the U-shaped channel resiliently into engagement with the fence lower edge.

6. The edging strip as set forth in claim 1 wherein the edging strip terminates at first and second longitudinal ends, and wherein the first flange defines a longitudinally extending, generally U-shaped slot at the first longitudinal end and second longitudinally extending generally U-shaped slot at the second longitudinal end, the first and second generally U-shaped slots being dimensioned for receiving a fence mounting post, whereby each edging strip is adapted to extend between adjacent fence mounting posts.

7. The edging strip as set forth in claim 6 wherein the second flange further includes a first elongated slot adjacent at least one of said first and second longitudinal end U-shaped slots, the elongated slot being adapted for slidably receiving a fastening means for connecting the longitudinal ends of a pair of edging strips together in a limited sliding arrangement, whereby longitudinal expansion and contraction of the edging strip with changes in temperature is permitted.

8. The edging strip as set forth in claim 7 wherein the longitudinal length of the elongated slot exceeds the change in length which the edging strip undergoes with a 100° F. temperature change.

9. The edging strip as set forth in claim 7 further including a generally annular fence mounting disc which has an inner opening that is dimensioned for tightly engaging the periphery of the fence mounting post and has a radially extending slot for facilitating placement of the annular disc around the fence mounting post, the annular disc being positioned on the fence mounting post under the second flange to block vegetation from growing through the second flange U-shaped slots.

10. A combined fence and vegetation blocking edging assembly comprising:

a fence structure including a plurality of spaced fence mounting posts and a flexible fencing medium which extends between the fence mounting posts and terminates adjacent the ground with a lower edge;

a plurality of annular fence post edging structures, one of which is disposed in conjunction with each fence mounting posts, each fence post edging structure having an inner opening which is dimensioned for tight frictional engagement with an associated fence mounting post, whereby the growth of vegetation closely adjacent the fence mounting post is blocked; and, a plurality of longitudinally elongated edging strips, each edging strip extending longitudinally between adjacent fence mounting posts, each edging strip including a generally J-shaped longitudinally extending fence engaging portion which is substantially J-shaped in transverse cross section and which receives the lower fence edge and engages one face of the fencing medium and first and second flanges extending traversely on opposite sides of the J-shaped fence engaging portion for inhibiting the growth of vegetation to either side of the fence lower edge, the first flange having generally U-shaped slots at longitudinal ends for receiving adjacent fence mounting posts, and first flange longitudinal ends overlaying the fence post edging structure, whereby vegetation is blocked from growing to either side of the fence lower edge and from growing between the edging strips and the fence mounting posts.

11. The combination as set forth in claim 10 wherein the fence post edging structure includes a generally radially extending slot to facilitate positioning the structure around mounting posts.

12. The combination as set forth in claim 11 wherein the fence post edging structure is constructed of a resilient material and includes first and second edges disposed adjacent the radially extending slot, the first and second edges being disposed in an overlapping relationship.

13. The combination as set forth in claim 12 wherein the fence post edging structure defines an inner, fence post engaging surface which is smaller than the fence mounting post in cross section such that the inner, fence post engaging surface is resiliently biased into contact with the fence mounting post.

14. The combination as set forth in claim 10 wherein the J-shaped fence engaging portion includes a shallow U-shaped portion and a single guide strip extending from one edge of the U-shaped portion and engaging a first face of the fencing medium.

15. The combination as set forth in claim 14 wherein the single guide strip is foreshortened adjacent the longitudinal ends such that the first and second flanges of adjacent edging strips overlap and the single guide strips of adjacent edging strips abut.

16. The combination as set forth in claim 15 further including an elongated slot in at least one of the first and second flanges adjacent a longitudinal end and a fastener extending through the elongated slot to connect the longitudinal ends of adjacent edging strips in a limited sliding relationship, whereby accommodation is made for expansion and contraction with changes in temperature.

* * * * *